United States Patent [19]

Dederer et al.

[11] Patent Number: 5,036,305

[45] Date of Patent: Jul. 30, 1991

[54] SEGMENTED INTERLAYER SPACER BARS FOR MULTILAYER SUPERCONDUCTING SOLENIDS

[75] Inventors: Jeffery T. Dederer, Allegheny County; Donald T. Hackworth, Monroeville, both of Pa.

[73] Assignee: Westinghouse Electric Corp., Pittsburgh, Pa.

[21] Appl. No.: 465,664

[22] Filed: Jan. 16, 1990

[51] Int. Cl.[5] ..... H01F 3/00

[52] U.S. Cl. ..... 335/216; 335/299; 335/266; 335/300; 505/1; 505/885; 505/879

[58] Field of Search ..... 335/301, 256, 255, 266, 335/216, 300; 505/879, 1, 885

[56] References Cited

U.S. PATENT DOCUMENTS

| | | | |
|---|---|---|---|
| 3,559,126 | 1/1971 | Drautman | 505/879 |
| 4,189,693 | 2/1980 | Satti | 505/879 |
| 4,295,111 | 10/1981 | Wang | 335/256 |
| 4,902,995 | 2/1990 | Vermilyea | 505/1 |

*Primary Examiner*—Leo P. Picard
*Assistant Examiner*—Trinidad Korka
*Attorney, Agent, or Firm*—M. G. Panian

[57] ABSTRACT

A spacer bar, or system of spacer bars, interposed between coil layers of a coil structure. The spacer bar comprises a block of electrical insulating material adapted to be arranged between adjacent layers of a coil. The spacer bar may comprise several spacer bar sections segmented axially and provided with flexible joints (e.g., Belleville washers) between sections to permit each section to move with the adjacent coil layers (the coil layers between which the section is interposed). The sections of the spacer bar are held together by passing a rod through holes provided through each section. Between each pair of spacer sections, a Belleville washer is installed to assure that under continued cycling (e.g., expansion and contraction of the coil), the spacer sections return to their original location. To maintain an adequate creep path at the ends of the blocks or sections, notches can be cut into a face of each block or section.

16 Claims, 2 Drawing Sheets

SEGMENTED INTERLAYER SPACER BARS FOR MULTILAYER SUPERCONDUCTING SOLENIDS

BACKGROUND OF THE INVENTION

The present invention relates to a spacer device and a multilayer coil arrangement employing the spacer device between radial layers of the coil arrangement.

The structures of large scale (e.g., 50–500 meter radius) superconducting magnetic energy storage (SMES) coils typically include several radial coil winding layers. In general, during operation of the coil, the outermost coil layers exert an inward radial load (radially directed toward the center of the coil), while the innermost coil layers exert an outward load (radially directed away from the center of the coil). The result is a net outward radial pressure that is carried by the coil structure or transmitted to an external support system. Such SMES coils typically require that the radial electromagnetic pressure exerted between layers be reacted partially within the coil structure, e.g., by bending or flexing of the coil layers and by pressing adjacent coil layers against each other.

With coil designs that require the conductors to be exposed to a liquid helium bath (or with forced flow conductors), it would be desirable to separate the layers to allow helium to access the inner layer windings. However, electromagnetic forces present during the operation of SMES coils would normally collapse separated layers together. Therefore, it would be desirable to provide a system which would allow separated coil layers to react electromagnetic loads against each other and remain separated.

SUMMARY OF THE INVENTION

It is therefore an object of the present invention to provide a device for maintaining coil layers of a winding coil separated during operation of the coil.

It is also an object of an embodiment of the present invention to provide a spacer bar designed to maintain coil layer separation and reduce slippage between the coil layers and the spacer bar, to, thereby, reduce frictional heat generated from such slippage and to reduce the likelihood of turn-to-turn insulation damage.

It is further an object of an embodiment of the present invention to provide a spacer bar designed to maintain electrical creep protection between layers.

It is also an object of an embodiment of the present invention to provide a spacer bar which can be installed in a manner to facilitate assembly of a coil stack.

These and other objects are accomplished according to the present invention by providing a spacer bar, or system of spacer bars, interposed between coil layers of a coil structure. According to an embodiment of the present invention, a spacer bar comprises a block of electrical insulating material adapted to be arranged between adjacent layers of a coil. According to another embodiment of the present invention, a spacer bar comprises several spacer bar sections segmented axially and provided with flexible joints (e.g., belleville washers) between sections to permit each section to move with the adjacent coil layers (the coil layers between which the section is interposed). The sections of the spacer bar are held together by passing a rod through holes provided through each section. Between each pair of spacer sections, at least one, and preferably several belleville washers are installed to assure that under continued cycling (e.g., expansion and contraction of the coil), the spacer sections return to their original location. In principle, the spacer bars could be divided into as many sections as there are axial coil turns effectively eliminating all the slip between bars and coil turns. In practice however, most of the slip could be removed by using a smaller number of sections thus simplifying the design. To maintain an adequate creep path at the ends of the blocks or sections, notches can be cut into a face of each block or section.

BRIEF DESCRIPTION OF THE DRAWINGS

The detailed description of the invention will be made with reference to the accompanying drawings, wherein like numerals designate corresponding parts in the several Figures.

DESCRIPTION OF THE PREFERRED EMBODIMENTS

The following detailed description is of the best presently contemplated mode of carrying out the invention. This description is not to be taken in a limiting sense, but is made merely for the purpose of illustrating the general principles of the invention. The scope of the invention is best defined by the appended claims.

The following description relates to spacer bar devices and a coil structure, such as a superconducting magnetic energy storage coil, which includes such spacer bar devices. However, it will be recognized that the present spacer bar device may be employed in any coil system in which coil layers are spaced apart from each other.

Figure 1:
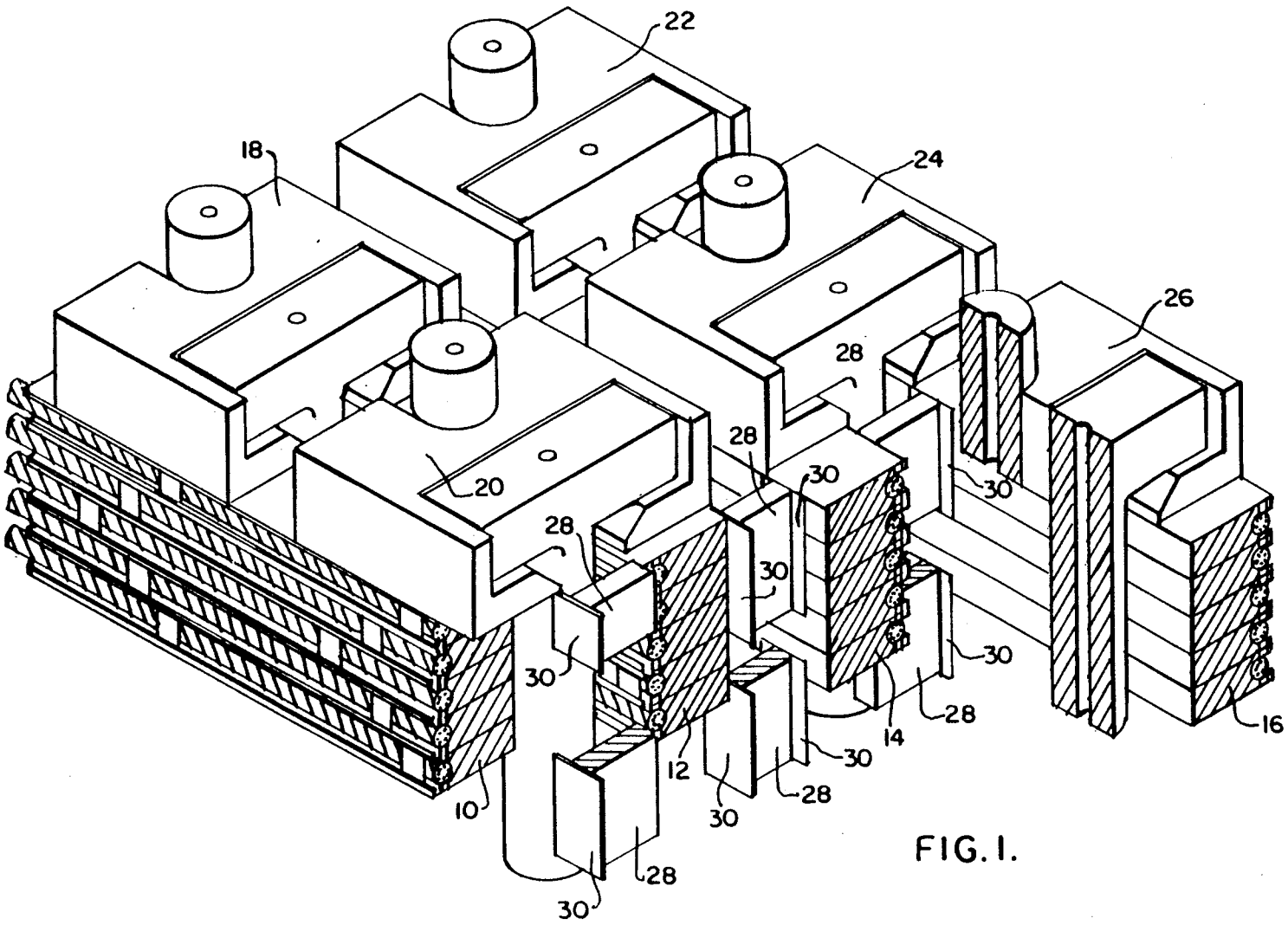
FIG. 1 shows a perspective view of a portion of a superconducting magnetic energy storage coil having four layers spaced apart by spacer bars according to an embodiment of the present invention.

According to an embodiment of the present invention, in order to allow separated coil layers to react electromagnetic loads against each other, several axially arranged insulated spacer bars are provided between each pair of adjacent coil layers about the circumference of the coil structure. A general layout of a portion of a coil structure and spacer bars according to an embodiment of the present invention is shown in FIG. 1. In FIG. 1, portions of four coil winding layers 10, 12, 14 and 16, respectively, are shown as being held by clamping devices 18, 20, 22, 24 and 26 in a mutually separated relationship.

As shown, each coil layer 10, 12, 14 and 16 is composed of a plurality of vertically spaced coil turns defining a cylinder having a vertical axis. The cylinders defined by the coil layers are coaxial to one another.

Interposed between the layers 10, 12, 14 and 16 are a plurality of vertically extending interlayer spacer bars 28. The interlayer spacer bars 28 are shown with end flanges 30 which may be secured to the coil layers, e.g., with epoxy adhesive or other suitable securing means. Flanges 30 provide relatively large surfaces for abutting against the coil layers. Flanges 30 also extend the inherent electrical creep paths which exists between adjacent layers during the operation of the coil. Spacer bars 28 and flanges 30 are composed of an insulating material, such as an insulating dielectric composition.

As the coil is cooled from ambient to liquid helium temperatures, the entire structure contracts axially according to the thermal properties of the materials from which the structure is made. This thermal contraction can give rise to several operational and safety problems in SMES coil systems. In general, different materials, e.g., aluminum and dielectrics such as epoxy glass or G-10, do not have equal contraction rates. At locations in such coil systems where these different materials are in contact with each other (e.g., where a spacer bar contacts a coil layer), either slippage occurs or the materials deform to accommodate the given differential thermal movement.

An additional and potentially more serious concern is that, during operation, slippage between the coil layers and the spacer bars could generate heat which must be removed from the helium bath. This slippage can occur from several sources. When the coil is charged, a compressive axial load is imposed on the structure resulting in a compression of the coil turns. Since the spacer bars described above have no axially directed load imposed directly on them, they must either carry a shear stress at the coil-bar interface and compress axially, or slip relative to the coil.

Another possible cause of slippage is due to the overall radial bending of the coil between strut lines. As the coil is charged and discharged, the coil layers flex outward behaving essentially as four parallel plates. On one side of each spacer bar, the coil structure is in compression, while on the other side the structure is in tension.

Figure 2:
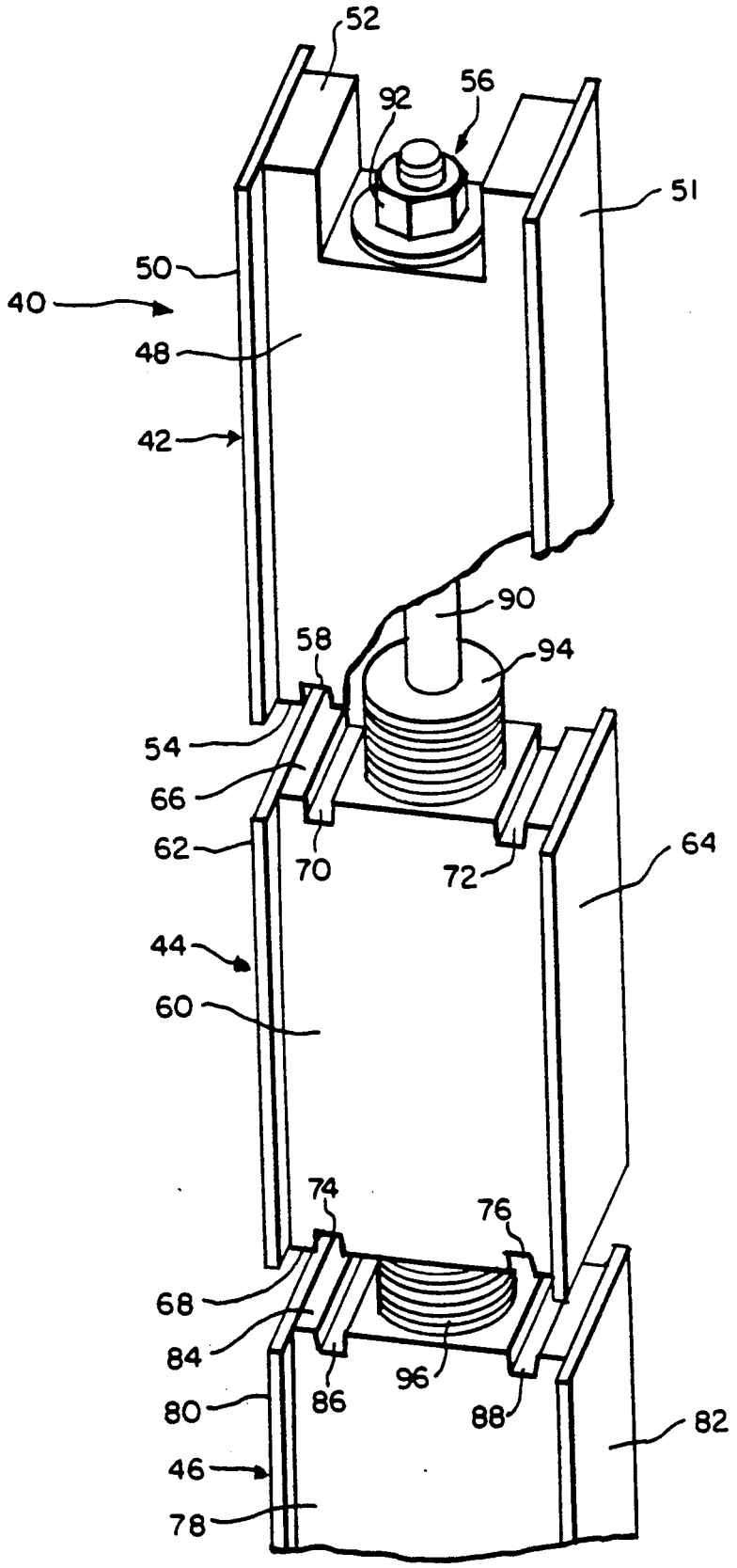
FIG. 2 is a perspective view of a portion of a segmented spacer bar according to another embodiment of the present invention.

FIG. 2 shows an embodiment of a spacer bar device designed to address the problems associated with the spacer bar device shown in FIG. 1. Referring to FIG. 2, a spacer bar 40 is shown as having three sections 42, 44 and 46, respectively. A portion of section 42 is cut away in FIG. 2 so as to show details of the connection between sections 42 and 44. Additionally, only a portion of section 46 is shown in FIG. 2.

Each section 42, 44 and 46 includes a dielectric block and two end flanges, similar to the spacer bar shown in FIG. 1. For example, section 42 includes a substantially rectangular cube-shaped dielectric block 48. Two flanges 50 and 51 are provided on two oppositely directed faces of dielectric block 48, respectively. As will be described below, flanges 50 and 51 are arranged to abut (and preferably be secured to) two adjacent coil layers in a coil structure.

Dielectric block 48 includes a surface 52, which is shown facing upward in FIG. 2 and a surface 54, which is shown facing section 44 in FIG. 2. Surface 52 is provided with a recessed notch 56. Surface 54 is provided with two recessed channels, one of which is shown at 58, the other channel not being shown in FIG. 2 due to the cutaway portion of section 42 in FIG. 2.

Section 44 also includes a dielectric block 60. Two flanges 62 and 64 are provided on two ends of dielectric block 60 in a manner similar to the manner in which flanges 51 and 52 are provided on dielectric block 48 of section 42. Dielectric block 60 includes a surface 66 which faces section 42 and a surface 68 which faces section 46. Each surface 66 and 68 is provided with two channels. Surface 66 is provided with channel 70 and channel 72, whereas surface 68 is provided with channel 74 and channel 76. Each channel 70, 72, 74 and 76 extends across the entire width of dielectric block 60.

Section 46 is also provided with a dielectric block 78 and two flanges 80 and 82 similar to the dielectric block and flanges provided in sections 42 and 44 described above. Dielectric block 78 includes a surface 84 which faces section 44 in FIG. 2. Surface 84 is provided with two channels 86 and 88 extending across the width of dielectric block 78. Dielectric block 78 includes a second surface (not shown) which faces opposite to surface 84. The configuration of this second surface is similar to the configuration of surface 52 of dielectric block 48. That is, the second surface (not shown) of dielectric block 78 includes a notch similar to notch 56 in surface 52 of dielectric block 48.

Sections 42 and 46 (which have a surface provided with a notch, e.g., surface 52 and notch 56) will be hereinafter referred to as end sections of spacer bar 40. Section 44 (which includes two surfaces 66 and 68 provided with channels 70, 72, 74 and 76) will be hereinafter referred to as a middle section of spacer bar 40. Preferably, spacer bar 40 is provided with two end sections and any number (including zero) of middle sections. In the FIG. 2 embodiment, spacer bar 40 is provided with two end sections 42 and 46, respectively, and one middle section 44.

During operation of the coil structure, an electrical creep path will inherently occur between adjacent coil layers across surfaces 54, 66, 68 and 84 of spacer bar sections 42, 44 and 46. Grooves 58, 70, 72, 74, 76, 86 and 88 are provided in these surfaces to extend and maintain an adequate creep path. That is, grooves 58, 70, 72, 74, 76, 86 and 88 enlarge the surfaces over which such creep paths occur and, thus, increase the effective resistance to electrical creep between adjacent coil layers. It will be recognized that the number of grooves on any one or all of the grooved surfaces of a spacer bar section may be more or less than two and can be chosen to accommodate a particular coil structure. Additionally, it will be recognized that notch 56 in surface 52 of spacer bar section 42 and flanges 50, 51, 62, 64, 80 and 82 of spacer bar sections 42, 44 and 46 also operate to extend the creep paths between coil layers.

As shown in FIG. 2, sections 42, 44 and 46 of spacer bar 40 are held in position relative to one another by a threaded (or partially threaded) rod 90. Rod 90 extends through a hole provided in section 42, from the notch 56 of surface 52 to surface 54 of dielectric block 48. Rod 90 also extends through a hole provided in section 44, from surface 66 to surface 68 of dielectric block 60. Additionally, rod 90 extends through a hole provided in section 46 from surface 84 to the surface (not shown) which faces opposite to surface 84 of dielectric block 78. The holes provided in section 42, 44 and 46 preferably have a diameter which is greater than the diameter of rod 90. In this manner, sections 42, 44 and 46 will be able to move laterally (radially) a slight distance, with respect to rod 90, when the spacer bar 40 is assembled as shown in FIG. 2 to follow radial expansion and contractions of the coil layers.

Rod 90 protrudes into notch 56 and into a notch (not shown) provided in a surface (not shown) which faces opposite to surface 84 in dielectric block 78. Within each notch (e.g., notch 56), a nut and washer assembly 92 threadably engages rod 90 so as to secure rod 90 with the spacer bar sections 42, 44 and 46. It will be recognized, however, that other suitable securing means may be employed as an alternative to nut and washer assembly 92.

As shown in FIG. 2, adjacent spacer bar sections are spaced from each other upon being connected by rod 90. The spacing between adjacent bars is maintained by a flexible spacer. In FIG. 2, the flexible spacer comprises a stack of belleville washers 94 interposed between sections 42 and 44 and a stack of belleville washers 96 interposed between sections 44 and 46. While the FIG. 2 embodiment shows a stack of eight belleville washers interposed between each pair of adjacent sections, any number of such washers, including one washer, may be employed for this purpose. Preferably, washer stack 94 abuts surface 54 of dielectric bar 48 and surface 66 of dielectric bar 60, and washer stack 96 abuts surface 68 of dielectric bar 60 and surface 84 of dielectric bar 78.

Due to the inherent flexibility of belleville washers, relative movement (in the vertical direction of FIG. 2) between adjacent sections may occur while the washer stack interposed between the sections maintains contact with the sections. Furthermore, since belleville washers are not only flexible, but are also resilient, washer stacks 94 and 96 operate to urge sections 42, 44 and 46 to their original spacings upon the occurrence of relative movement between adjacent sections. While the FIG. 2 embodiment employs stacks of belleville washers to provide flexible and resilient spacers between adjacent sections, it will be recognized that other suitable devices, e.g., springs, may be used as an alternative or in conjunction with the washer stacks.

Spacer bar 40 may be used in a coil structure, such as shown in FIG. 1 (e.g., instead of each spacer bar 28), to maintain adjacent coil layers in a spaced relationship. Spacer bar 40 may be designed with the number of sections chosen to accommodate a particular coil structure. By employing a spacer bar 40, as described above, spacer bar sections may be supported by rod 90 and may be movable in the radial and axial directions of rod 90 to conform and absorb the movement and forces exerted by coil layers of a coil structure.

The number of sections and the number of washers in a washer stack may be chosen to accommodate a particular coil structure. Sections or washers may be added or removed from a spacer bar 40 simply by removing nut and washer assembly 92 and sliding sections or washers onto or off of rod 90. Rod 90 may be replaced by a longer or a shorter rod to accommodate more or less sections and washers. A technician may be provided with several end sections (e.g., section 42), several middle sections (e.g., section 44), several belleville washers, several nut and washer assemblies 92, and several rods 90 of differing lengths. In this manner, the technician may pick and choose the appropriate parts and assemble a spacer bar 40 designed for a particular coil structure.

Installation of spacer bar 40 within a coil structure can be a relatively simple operation. That is, spacer bar 40 may be installed one section at a time without having a full-length bar in place during the entire coil assembly and winding. A first spacer bar section may be installed and once the coil layers are wound around the first spacer bar section, a second spacer bar section can be installed and connected with the first section. Once coil layers are wound around the second spacer bar section, then a third section may be installed. This process continues until a fully wound coil is formed. Preferably, spacer bar flanges are secured to adjacent coil layers, e.g., with an epoxy adhesive or other suitable securing means.

When installed in the coil structure, a spacer bar will maintain a spacing between adjacent coil layers and between adjacent spacer bar sections. In this manner, accesses or flow paths for liquid helium may be maintained between coil layers and spacer bar sections.

Referring to FIG. 1, during operation of the coil system, axial contraction is typically greater near the top of each coil layer 10, 12, 14 and 18. By interposing spacer bars 40 between adjacent coil layers, most of the contraction forces can be absorbed at the joints between adjacent spacer bar sections and can be distributed through the spacer bar sections to some or all of the joints.

By absorbing forces and movements exerted by coil layers, the above-described spacer bar can reduce slippage between coil layers and the spacer bar sections and thereby reduce frictional heat which would normally be generated by such slippage. Reducing frictional heat in the cryogenic environment of the liquid helium bath is a substantial concern in superconducting coil structures.

Additionally, by absorbing relative motion between the spacer bar and the coil layers, the likelihood of frictional damage to the insulation provided on the conductors forming the coil layers may be reduced.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. In a multilayer coil structure having at least two adjacent coil layers, the improvement comprising:

a plurality of spacers interposed between the adjacent coil layers and separated from one another to provide open spaces between the layers, each of said spacers comprising:

a first block of insulating material;

a second block of insulating material;

a rod connecting said first and second blocks; nd a resilient member interposed between said first and second blocks.

2. A coil structure as claimed in claim 1 wherein each said block of insulating material has a first surface facing one of two adjacent coil layers and a second surface facing the other of the two adjacent coil layers;

a first flange provided on said first surface; and a second flange provided on said second surface.

3. A coil structure as claimed in claim 1 wherein each of said first and second blocks has a first surface facing one of two adjacent coil layers, a second surface facing the other of the two adjacent coil layers, a first flange provided on said first surface, and a second flange provided on said second surface.

4. A coil structure as claimed in claim 1 wherein:

said first block has a hole extending therethrough;

said second block has a hole extending therethrough; and said rod extends through the holes in said first and second blocks.

5. A coil structure as claimed in claim 4 wherein the holes provided in said first and second blocks have cross-section areas which are greater than the cross-section area of said rod.

6. A coil structure as claimed in claim 1 wherein said resilient member comprises a belleville washer.

7. A coil structure as claimed in claim 1 wherein said resilient member comprises a stack of a plurality of belleville washers.

8. A coil structure as claimed in claim 1 wherein each of said spacers further comprises:

a third block of insulating material connected with said second block by said rod; and a second resilient member interposed between said second and third blocks.

9. A coil structure as claimed in claim 8 wherein each said resilient member comprises a belleville washer.

10. A coil structure as claimed in claim 8 wherein each said resilient member comprises a stack of a plurality of belleville washers.

11. A coil structure as claimed in claim 1 wherein said coil structure comprises a cryogenically cooled superconducting coil.

12. A coil structure as claimed in claim 1 further comprising a cooling fluid disposed within said open spaces provided between the coil layers.

13. A coil structure as claimed in claim 12 wherein said cooling fluid comprises a cryogenic fluid.

14. A coil structure as claimed in claim 12 wherein said cooling fluid comprises liquid helium.

15. A coil structure as claimed in claim 1 wherein:

said coil structure has a longitudinal axis;

each of said coil layers is wound in the form of a cylinder coaxial with the longitudinal axis of said coil structure;

said rod of each said spacer has a longitudinal axis which extends parallel to the longitudinal axis of said coil structure; and each said block of each said spacer is movable relative to its associated rod parallel to the longitudinal axis of the associated rod.

16. A coil structure as claimed in claim 15 wherein the cylinders formed by said at least two coil layers have respectively different diameters.

* * * * *